United States Patent [19]

Fontannaz

[11] Patent Number: 4,704,980

[45] Date of Patent: Nov. 10, 1987

[54] DEVICE FOR FIXING THE WISHBONE BOOM TO THE MAST OF A SAILBOARD

[76] Inventor: Manuel Fontannaz, CH-1845 Noville, Switzerland

[21] Appl. No.: 929,443

[22] Filed: Nov. 12, 1986

[30] Foreign Application Priority Data

Nov. 22, 1985 [CH] Switzerland ..... 4987/85

[51] Int. Cl.[4] ..... B63H 9/10

[52] U.S. Cl. ..... 114/98; 114/39.2

[58] Field of Search ..... 114/97, 98, 89, 99, 114/102, 108, 39, 39.2

[56] References Cited

U.S. PATENT DOCUMENTS

| | | | |
|---|---|---|---|
| 4,424,759 | 1/1984 | Dolence | 114/97 |
| 4,448,142 | 5/1984 | Pollard | 114/39.2 |
| 4,516,873 | 5/1985 | Humble et al. | 114/39.2 |
| 4,546,720 | 10/1985 | Dumortier | 114/98 |
| 4,587,916 | 5/1986 | Guerette | 114/98 |

*Primary Examiner*—Jeffrey V. Nase

*Assistant Examiner*—Jesûs D. Sotelo

*Attorney, Agent, or Firm*—Pollock, VandeSande and Priddy

[57] ABSTRACT

The front body (2) has holes (3, 4) for receiving the ends of the wishbone boom, and an arched surface (7) intended to be applied against the mast. An arched clamping piece (9) is provided at each end with a metal rod (10, 11), each of which is intended to pass through a hole in the front body (2). The free end of these rods is threaded (13, 16) and projects beyond the body (2). The rod (10) is straight and the rod (11) is bent. A nut (17) is intended to cooperate with the thread (16) on the bent rod so as to ensure that the mast is held, with play, between the two arched parts (7, 9), while another nut (14), cooperating with the thread (13) on the rectilinear rod, enables the windsurfer to lock the device on the mast after having slid it to the height which suits him. This device can be fitted to the mast, with play, before the sailboard is put in the water and enables the height on the mast to be adjusted while sailing.

6 Claims, 1 Drawing Figure

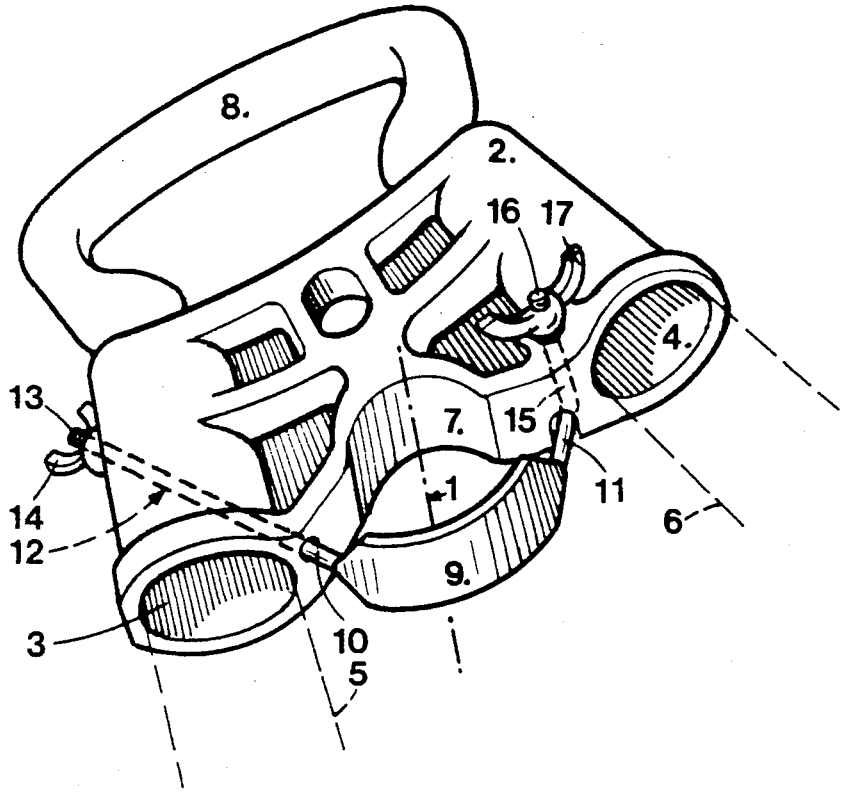
8.
2.
16
17
4.
13
7.
15
14
1
11
12
6
9.
3
10
5

DEVICE FOR FIXING THE WISHBONE BOOM TO THE MAST OF A SAILBOARD

The conventional way of fixing the wishbone boom to the mast of a sailboard consists in using a small cord which passes through a hole in the fixing body of the wishbone boom and with which a capstan knot is tied around the mast at the location of the aperture provided for this purpose in the sleeve of the sail. This arrangement has a number of disadvantages: the capstan knot can come untied spontaneously during sailing, making it necessary for the windsurfer to retie this knot on the water; furthermore, to adapt the sailboard to the height of different windsurfers, the height of the position of the capstan knot on the mast has to be changed; the operation is not always easy, especially if the knot is tight and the cord wet. On the other hand, it is scarcely possible to envisage fixing means integral with the mast itself since they would dangerously weaken the mast.

A mechanical fixing device is also known which makes it possible to lock the fixing body of the wishbone boom at a chosen height along the mast (published French Patent Applications Nos. 2558091 and 2566365). However, this solution has the disadvantage of not allowing the height to be adjusted on the water, where the sail is stretched between the mast and the end of the wishbone boom by means of a cord and pulleys. This operation of stretching the sail can only be carried out on land (prior to sailing) because of the strength it requires. To adjust the height of the wishbone boom on the mast, the clamping system has to be unlocked, which is when the high tension exerted by the sail does not allow it to be returned to the locked position; it is therefore necessary to return to land, release the sail tension, lock the system at the desired height, re-stretch the sail and return to the water.

The object of the present invention is to provide a device for fixing the wishbone boom to the mast of a sailboard which does not have all these disadvantages and ensures effective fixing; it relates to such a device, which conforms with claim 1.

The single figure in the attached drawing shows, by way of example and in perspective, an embodiment of the fixing device according to the invention.

In the drawing, the dot-and-dash line 1 represents the axis of the mast (not shown) of a sailboard. 2 shows the front fixing body of the wishbone boom, which, as is conventional, has two holes 3,4 for receiving and holding the two front ends of the arms 5, 6 of the wishbone boom. As is also conventional, the body 2 has an arched surface 7 shaped for application against the front part of the mast. The usual handle 8 is provided at the front part of the body 2. The latter is preferably made of a slightly elastically deformable, moulded plastic to ensure a good fit between the surface 7 and the mast, the diameter of which may vary somewhat from case to case.

In addition to the known members which have now been described, this embodiment comprises a clamping piece 9 shaped for application against the rear part of the mast, opposite the arched part 7 of the body 2. This clamping piece 9 is in the form of a metal or reinforced plastic band. This embodiment further comprises mechanical clamping means which will now be described and which are provided so as to force the clamping piece 9 to grip the mast firmly between itself and the arched surface 7 of the body 2, thereby fixing the wishbone boom to the mast.

These mechanical clamping means comprise two metal rods 10, 11, each fixed to one end of the band 9 forming the clamping piece. The rod 10 is rectilinear and is intended to be inserted in a hole 12 in the body 2 and to pass right through it so that its free end 13, which is threaded, projects beyond the body 2, where it receives a wing nut 14 (or other kind of nut) which can be turned by hand so as to pull the rod 10 while itself bearing against the body 2.

In the working position of the device on the mast, the hole 12 and the rod 10 which passes through it are horizontal.

In its part adjacent to the band 9, the rod 11 has a shape symmetrical to that of the rod 10. However, as the directions in question are divergent rather than parallel, the rod 11 has a part 15 bent at a right-angle so that the rods 10 and 11 can easily be positioned on the body 2 and detached from this body, the said bent part being intended to pass through a hole in the body 2, which is vertical in the working position of the device. The free end of the terminal part 16 of the rod 11 is threaded to receive a wing nut 17 (or other kind of nut) for immobilizing the rod 11 on the body 2.

The device works in the following way:

To fit the device to the mast of the sailboard at the location of the aperture provided for this purpose in the sleeve of the sail, the body 2 is presented so that its part 7 is applied against the mast at approximately the desired height, while the sailboard is on land, the nut 14 being slightly loose. The nut 17 is then removed and the part 15 of the rod 11 is released from the body 2, the clamping piece 9 being rotated 90° about the axis of the rod 10 and turned to face downwards. Once this has been done, the fixing body 2 is placed against the mast, the piece 9 is pivoted through 90°, bringing the bent part 15 of the rod 11 into the position shown in the drawing, and the nut 17 is tightened to immobilize the rod 11. The sailboard can then be put in the water and the user can climb on it and adjust the height of the device exactly by sliding it along the mast. When this desired height has been reached, the user need only tighten the nut 14 fully in order to immobilize the device by clamping the mast strongly between the parts 7 and 9. All this can be done without exerting any force to keep the device on the mast.

While sailing, the windsurfer is not required to make any great effort to change the height of the device. He simply has to loosen the nut 14 slightly in order to be able to move the device into the new desired position by sliding it along the mast, and then lock the device in position by fully retightening the nut 14.

Thus, when the sailboard is on the water, adjustment of the height of the device along the mast, so that it is adapted to the height of the windsurfer, is easy and requires no more effort than that needed to maneuver the nut 14, which is negligible.

In modified embodiments, provision could be made for the rods 10 and 11 to be articulated on the clamping piece 9 or for the arched part 7 of the body 2 to be curved like a portion of a torus, rather than cylindrical, in order to make it possible to provide the body 2 and hence the wishbone boom with a certain inclination, for example of 15°, relative to the perpendicular to the mast of the sailboard, as it is sometimes necessary to do.

What is claimed is:

1. A device for fixing the wishbone boom to the mast of a sailboard, comprising a front fixing body (2) having, on the one hand, means for receiving and holding the two front ends of the arms (5, 6) of the wishbone boom and, on the other hand, an arched surface (7) shaped for application against the front part of the mast, and a clamping piece (9) of arched shape, which is intended to be applied against the rear part of the mast, opposite the arched part (7) of the said front fixing body (2), wherein mechanical means (10, 11, 12, 13, 14, 15, 16, 17) are provided for joining and clamping the mast between this body (2) and this clamping piece (9), and wherein the arched part of the clamping piece (9) is extended, at each end, by a rod (10, 11) which is threaded (13, 16) at its free end, these threaded rods being intended to pass through channels made in the front fixing body (2), and nuts (14, 17), which can be turned by hand, being intended to cooperate with the threaded part (13, 16) projecting beyond these channels, on the one hand to simply fit the device to the mast with the freedom to slide it along the mast, before the sailboard is put in the water, and on the other hand to enable the user on the sailboard to bring the device to the height which suits him and to lock the device on the mast, at this height, by fully tightening the said nuts (14, 17), which then bear against the said body (2), or, conversely, to enable the user to change the height of the device while sailing, by partially loosening the nut (14) and then adjusting the height of the device and locking the device on the mast by fully tightening the nut (14).

2. The device as claimed in claim 1, wherein the said clamping piece (9) has an arched shape and is integral at each end with a metal rod (10, 11) threaded at its opposite, free end, holes being provided in the front fixing body (2) so that one of these rods can pass through each of them, and a nut (14, 17) being intended to cooperate with the threaded, free end (13, 16) of each of these rods so as to pull these rods while bearing against this fixing body (2).

3. The device as claimed in claim 2, wherein one (10) of the metal rods is rectilinear and is intended to pass through one of the holes (12), which passes horizontally through the said fixing body (2) in the working position of the device, while the other rod (11) is bent, its part adjacent to the clamping piece (9) being arranged symmetrically to the rectilinear rod (10), and the bent part (15) being intended to pass through one of the holes, which passes vertically through the said fixing body (2) in the working position of the device.

4. The device as claimed in claim 3, wherein cooperation between the threaded end (16) of the bent rod (11) and its nut ensures that the device is held on the mast, while fully tightening the other nut (14) on the threaded end (13) of the other rod (10) ensures that the device is locked on the mast.

5. The device as claimed in claims 1 or 4, wherein the said clamping piece (9) and the said mechanical means for joining and clamping (10, 11, 12, 13, 14, 15, 16, 17) can be separated from the front fixing body (2).

6. The device as claimed in claim 1, wherein the arched part (7) of the body (2) is curved like a portion of a torus, for allowing the body (2) and the wishbone to be inclined with respect to the perpendicular to the mast.

* * * * *